US011203835B2

(12) United States Patent
Rosa et al.

(10) Patent No.: US 11,203,835 B2
(45) Date of Patent: Dec. 21, 2021

(54) DOMESTIC APPLIANCE FOR IRONING CLOTHES AND SIMILARS

(71) Applicant: De' Longhi Appliances S.r.l. Divisione Commerciale ARIETE, Campi Bisenzio (IT)

(72) Inventors: Carlo Rosa, Calenzano (IT); Michele Picchi, Pontedera (IT); Filippo Cifarelli, Florence (IT); Alessio Rotondo, Prato (IT)

(73) Assignee: De' Longhi Appliances S.r.l. Divisione Commerciale ARIETE, Campi Bisenzio (IT)

( * ) Notice: Subject to any disclaimer, the term of this patent is extended or adjusted under 35 U.S.C. 154(b) by 142 days.

(21) Appl. No.: 16/491,694

(22) PCT Filed: Mar. 7, 2018

(86) PCT No.: PCT/IB2018/051479
§ 371 (c)(1),
(2) Date: Sep. 6, 2019

(87) PCT Pub. No.: WO2018/167609
PCT Pub. Date: Sep. 20, 2018

(65) Prior Publication Data

US 2021/0131023 A1 May 6, 2021

(30) Foreign Application Priority Data

Mar. 15, 2017 (IT) ..... 102017000028853

(51) Int. Cl.
*D06F 75/30* (2006.01)
*D06F 75/14* (2006.01)
(Continued)

(52) U.S. Cl.
CPC ..... *D06F 75/30* (2013.01); *D06F 75/14* (2013.01); *D06F 75/24* (2013.01); *D06F 75/34* (2013.01); *D06F 87/00* (2013.01)

(58) Field of Classification Search
CPC ..... D06F 75/00–40; D06F 87/00
See application file for complete search history.

(56) References Cited

U.S. PATENT DOCUMENTS 1,958,592 A * 5/1934 Ruelland ..... D06F 75/34 219/245
1,965,746 A * 7/1934 Matveyeff ..... D06F 75/40 38/79

(Continued)

FOREIGN PATENT DOCUMENTS

| | | |
|---|---|---|
| CN | 201 525 972 U | 7/2010 |
| CN | 103 334 280 B | 5/2015 |
| TM | M 334 141 U | 6/2008 |

OTHER PUBLICATIONS

Patent Cooperation Treaty, International Search Report and Written Opinion for International Application No. PCT/IB2018/051479, dated May 6, 2018, 10 pages.

*Primary Examiner* — Ismael Izaguirre
(74) *Attorney, Agent, or Firm* — Stetina Brunda Garred & Brucker

(57) ABSTRACT

An appliance for ironing clothes and similar, comprising a body adapted to support a soleplate and fixed to a handgrip; heating means arranged within said body and connectable to an electricity network for the heating of said plate; and means for generating steam connected to a water tank and to said plate to diffuse steam towards the outside via first and second holes arranged on said plate; said body being mounted rotatable around an axis of lateral rotation passing through said handgrip; said axis passing through said handgrip at an anterior portion of the handgrip and being (Continued)

inclined by an angle with respect to said handgrip so as to allow a user of the appliance to move said body and said plate between a first operating position for ironing said clothes in direct contact with said plate, and a second operating position for vertical steam ironing of said clothes also not directly in contact with the clothes; characterized in that in at said second operating position for vertical ironing, said plate is arranged in a position rotated by 180° around said axis with respect to the position assumed by said plate in said first operating position.

6 Claims, 7 Drawing Sheets

(51) Int. Cl.

| | |
|---|---|
| ***D06F 75/24*** | (2006.01) |
| ***D06F 75/34*** | (2006.01) |
| ***D06F 87/00*** | (2006.01) |

(56) References Cited

U.S. PATENT DOCUMENTS

| | | | | | |
|---|---|---|---|---|---|
| 2,013,854 | A | * | 9/1935 | Ruelland | D06F 75/30<br>219/245 |
| 2,109,326 | A | * | 2/1938 | Tricomi | D06F 75/16<br>38/77.83 |
| 2,418,020 | A | * | 3/1947 | Finlayson | D06F 75/40<br>38/79 |
| 2,433,556 | A | * | 12/1947 | Hume | D06F 75/14<br>38/77.82 |
| 2,864,186 | A | * | 12/1958 | Praud | D06F 79/02<br>38/77.6 |
| 2,866,283 | A | * | 12/1958 | Bricker | D06F 75/18<br>38/77.83 |
| 2010/0313453 | A1 | | 12/2010 | Pan et al. | |
| 2012/0131822 | A1 | | 5/2012 | Pan et al. | |

* cited by examiner

DOMESTIC APPLIANCE FOR IRONING CLOTHES AND SIMILARS

STATEMENT RE: FEDERALLY SPONSORED RESEARCH/DEVELOPMENT

Not Applicable

CROSS-REFERENCE TO RELATED APPLICATIONS

The present application claims priority to PCT International Application No. PCT/IB2018/051479 filed on Mar. 7, 2018, which application claims priority to Italian Patent Application No. 102017000028853 filed on Mar. 15, 2017, the entirety of the disclosures of which are expressly incorporated herein by reference.

BACKGROUND

The present invention concerns a domestic appliance for ironing clothes and similar.

In particular, the invention in question is advantageously used for effectively ironing garments and items of clothing and linen in general, to which the following description will explicitly refer without any loss of generality, both directly in contact with the clothes lying flat on a work surface (table or ironing board), and in a vertical position exploiting the force of the steam without contact with the clothes.

BRIEF SUMMARY

The object of the present invention is to produce a combined appliance which can be easily and rapidly converted from iron for contact ironing to garment steamer, i.e. for vertical steam ironing, and vice versa, thus being more effective and more convenient to use than the known appliances described for example in the patent documents TWM334141, US2010313453, US2012131822, CN201525972 and CN103334280.

A further object of the present invention is to produce a combined appliance that guarantees a high and optimal flexibility of use.

BRIEF DESCRIPTION OF THE DRAWINGS

Further characteristics of the invention and the resulting advantages will become clearer from the claims below and from the following description referring to the figures of the accompanying drawings, which show a preferred but not limiting embodiment of the ironing appliance in question, in which:

DETAILED DESCRIPTION

Figure 1A:
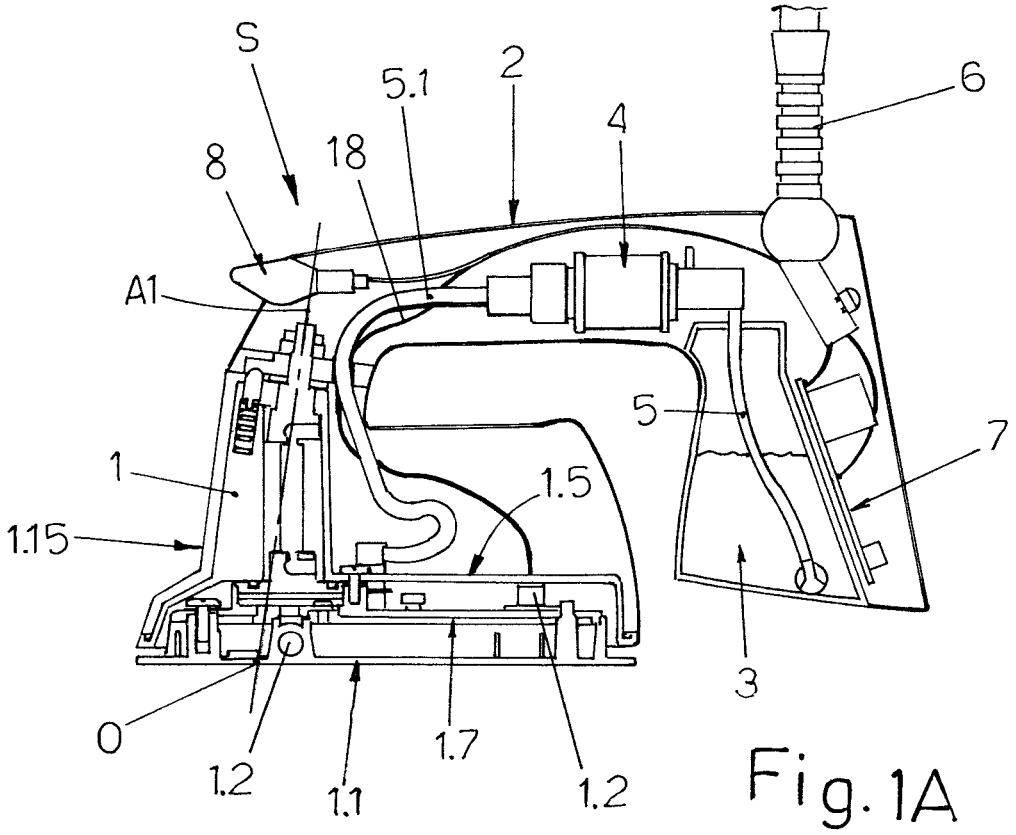
FIG. 1A shows, in a lateral view in section, a preferred embodiment of the ironing appliance in question.
Figure 1B:
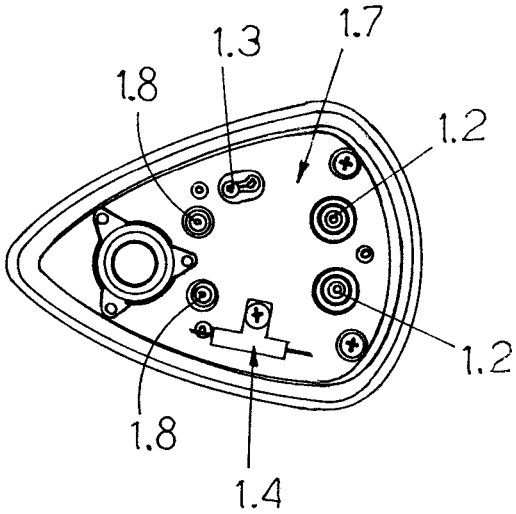
FIGS. 1B and 1C show the appliance of FIG. 1, in a plan view from above and in a plan view from below respectively.
Figure 1C:
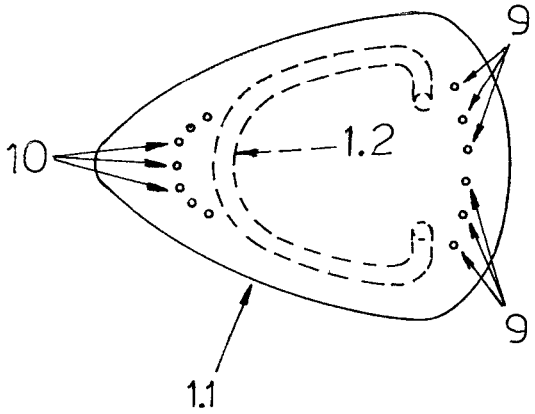

With reference to FIGS. 1A to 1C, the letter S indicates overall a domestic appliance for ironing garments, items of clothing and linen in general.

The appliance S comprises a body 1 provided with a hot metal soleplate 1.1, which is provided with an electrical resistance 1.2 for heating the plate, temperature control means like a thermostat 1.3 and a thermal fuse 1.4, and an inner insulating body 1.5 and an outer insulating body 1.15.

The body 1 with the plate 1.1 are fixed to a handgrip 2 which comprises at the rear a tank 3 for the water from which an electric pump 4, by means of hoses 5 and 5.1, sucks the water which is injected into the hot metal plate 1.1 in contact with which the steam is produced for the ironing.

The handgrip 2 is provided with an electrical supply cable 6, an electronic board 7 if necessary and a control button 8, by means of which the user can operate the electric pump 4 and therefore deliver steam from the holes 9 and 10 arranged on the hot metal plate 1.1.

Figure 2:
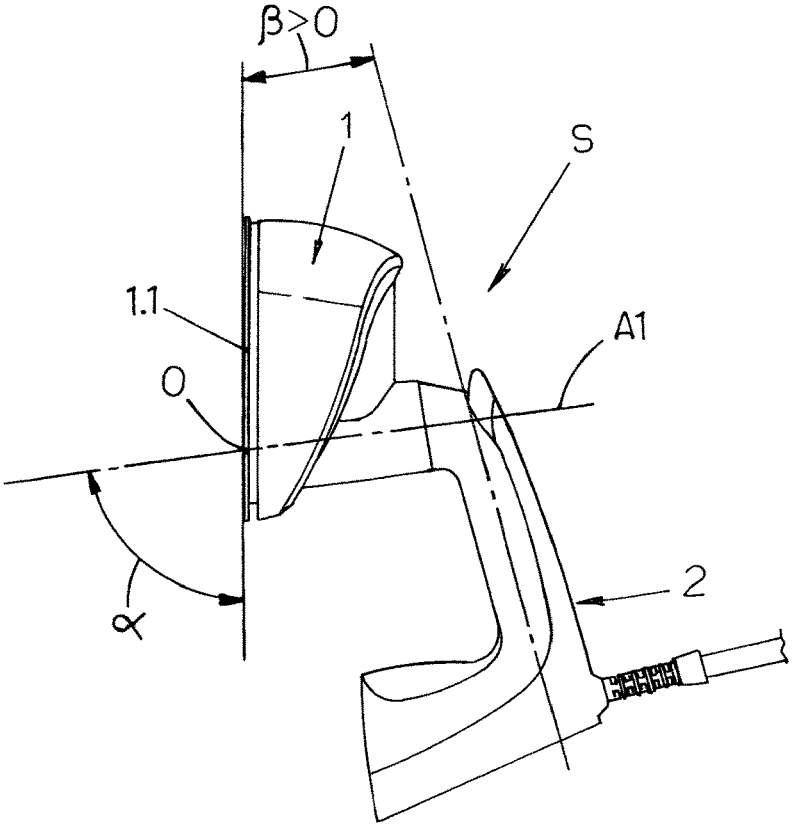
FIG. 2 shows a lateral view of the appliance of FIG. 1 in a first operating position (garment steamer for vertical ironing)
Figure 3:
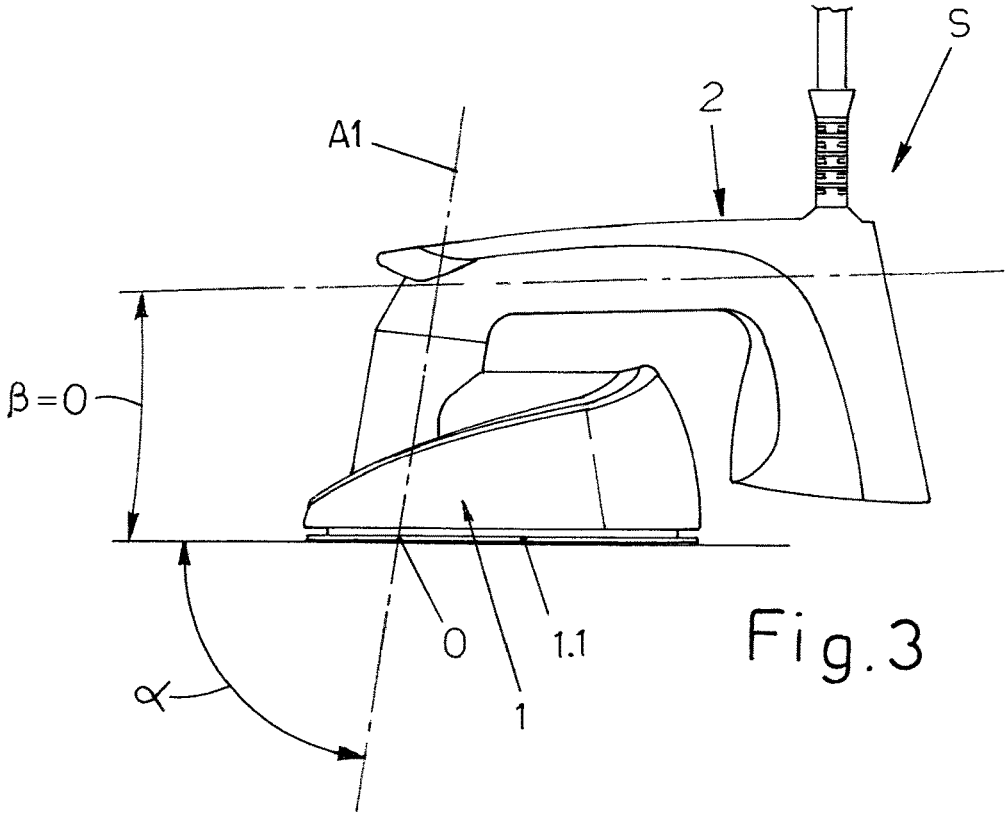
FIG. 3 shows a lateral view of the appliance of FIG. 1 in a second operating position (iron for horizontal contact ironing)
Figure 4:
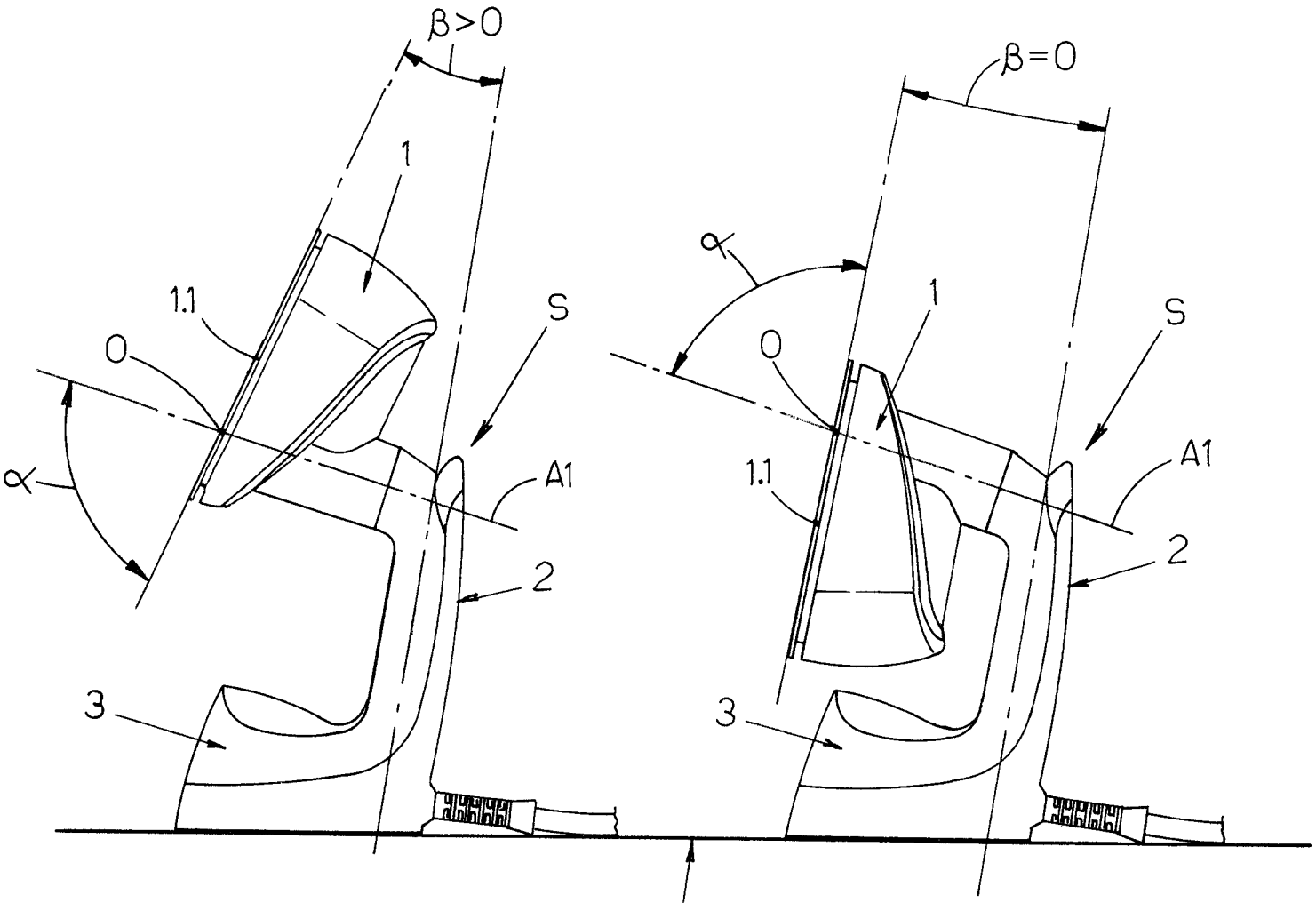
FIG. 4 shows a lateral view of the appliance of FIG. 1 in the conversion from the operating position shown in FIG. 2 to the operating position of FIG. 3.
Figure 5:
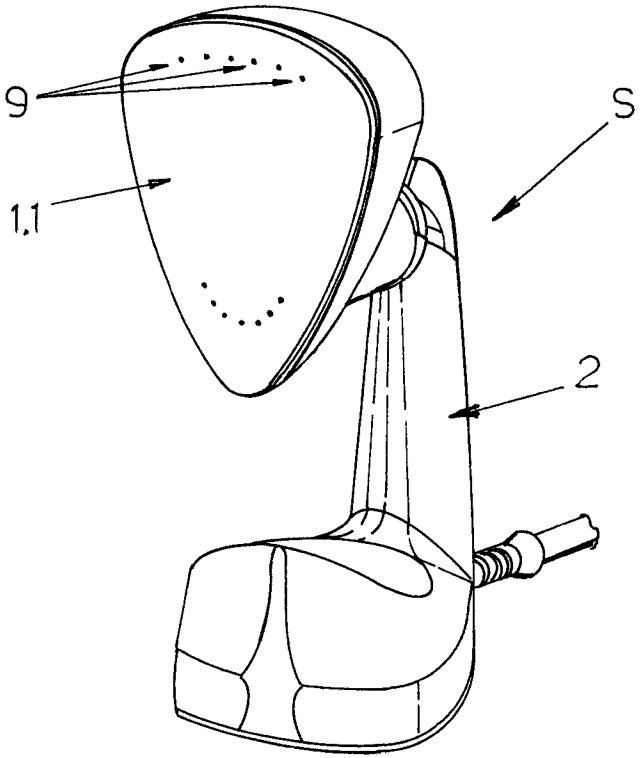
FIG. 5 is a perspective view of the appliance in question in the vertical operating position of FIG. 2.
Figure 6:
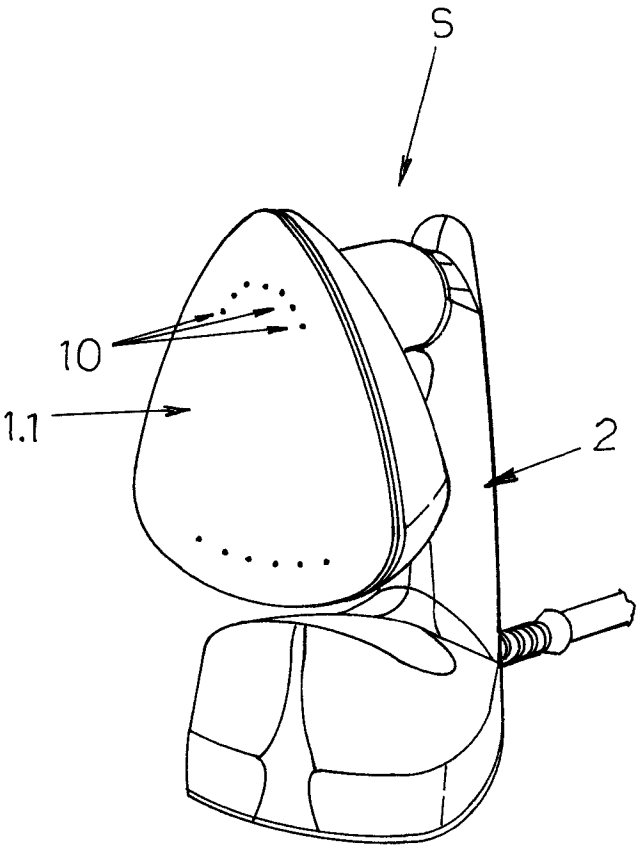
FIG. 6 is a perspective view of the appliance in question in the operating position of FIG. 3.

According to what is better illustrated in FIGS. 2 to 6, the appliance S is purposely and advantageously designed to have, in a combined manner, two alternative operating modes/positions: one for vertical steam ironing without direct contact with the clothes, i.e. with the body 1 and the relative plate 1.1 in the configuration of FIG. 2—Garment steamer, and the other for traditional ironing directly in contact with the clothes arranged and lying on a horizontal ironing surface, i.e. with the body 1 and the relative plate 1.1 in the configuration of FIG. 3—Iron.

The change of operating mode between the cited positions garment steamer/iron can be easily and rapidly obtained by rotating the handgrip 2 of the appliance S with respect to the body 1. The following combinations are therefore possible, as highlighted in FIG. 4 where the two operating positions are illustrated side by side positioned on the same horizontal support surface P:

(1) 180° rotation around a lateral rotation median axis A1 perpendicular to the plate 1.1, with the handgrip 2 always parallel to the plate even when rotating (angle $\beta=0$)

(2) 180° lateral rotation around the median axis inclined by an angle $\beta>0$ with respect to the handgrip 2 and passing through the handgrip 2 at an anterior portion of the handgrip 2.

In this way the axis A1 is arranged laterally with respect to a central median axis of the body 1, thus permitting the iron configuration in use with handgrip 2 substantially above the plate 1.1 (FIG. 3), and the garment steamer configuration in use with handgrip 2 in a substantially retracted position to the plate 1.1. (FIG. 2).

The specific particular design of the handgrip 2 and the tank 3 furthermore advantageously allow the appliance to be rested in stand-by in a substantially vertical position with respect to the surface P, both in the garment steamer mode and in the iron mode.

Said function is very useful to avoid the hot plate 1.1 remaining in contact with the horizontal work surface PI with the risk of burning the fabric of the clothes or the work surface itself.

According to the selected operating mode, the rotation of the handgrip 2 automatically changes the holes 9 and 10 from which the steam is emitted: in the garment steamer position, the steam is in fact emitted from the upper holes 9 of the plate 1.1, whereas in the iron position, the steam comes out of the front holes 10 of the plate 1.1.

Figure 7A:
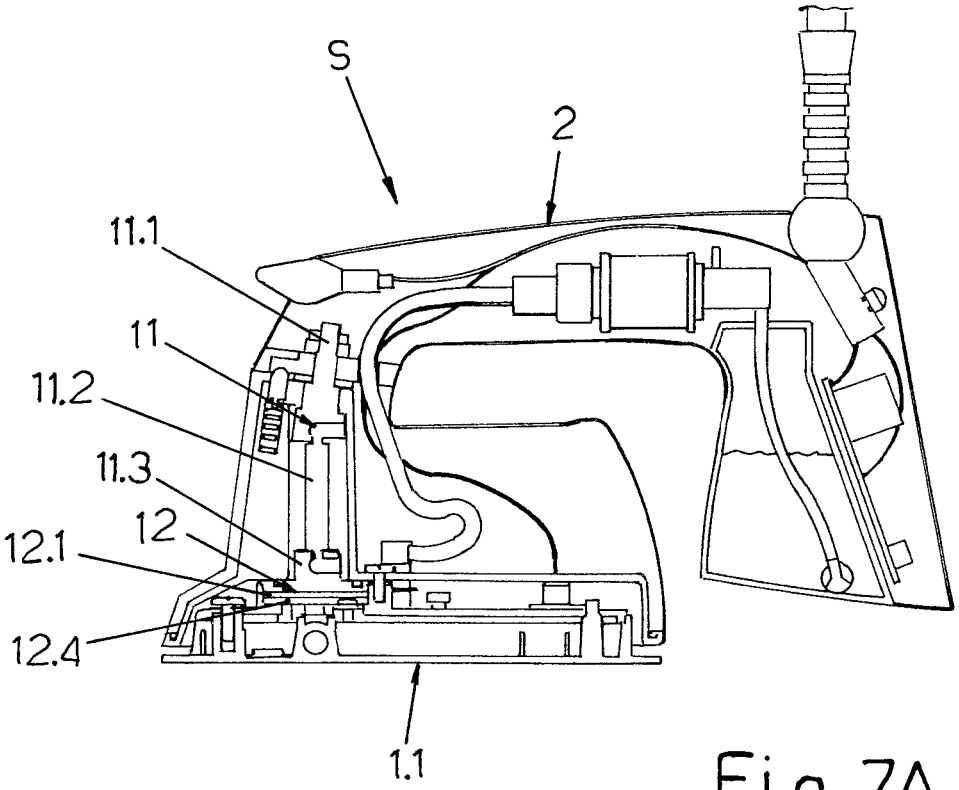
FIGS. 7A to 7C show, respectively, a lateral view in section, an overhead plan view and an overall exploded view of the appliance in question.
Figure 7B:
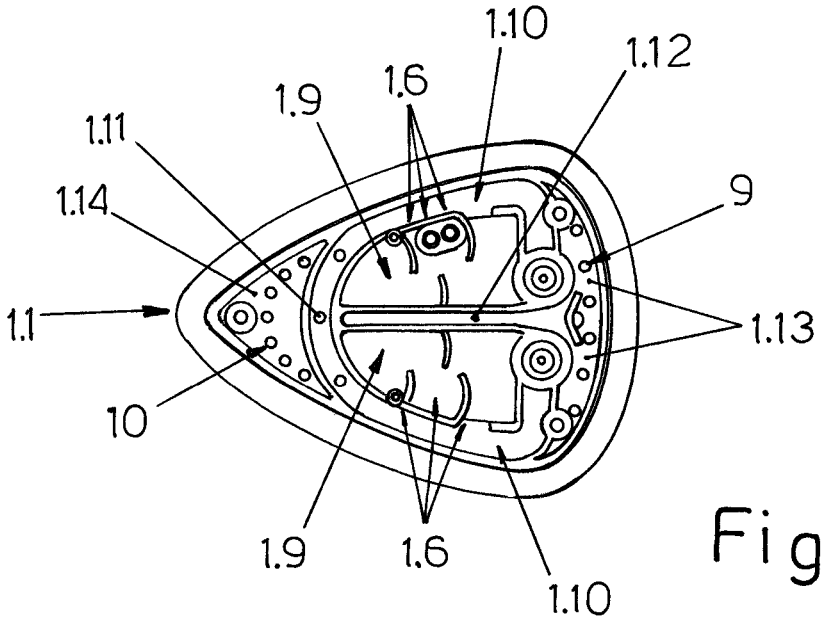
Figure 7C:
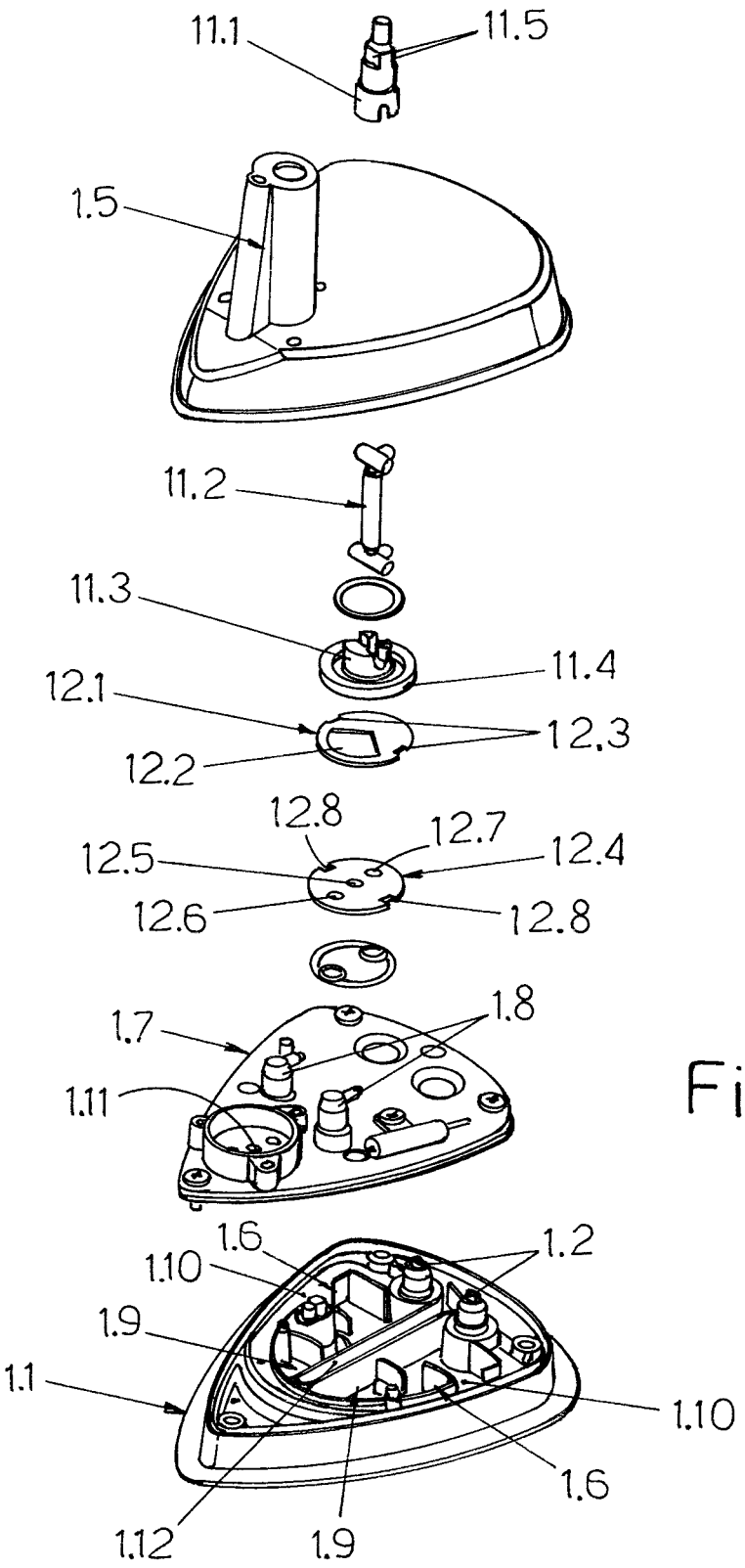

As can be seen from FIGS. 7A, 7B and 7C, the automatic change of the steam outlet holes 9 and 10 by means of rotation of the handgrip 2 is made possible due to a mechanical articulation 11 designed to control a hydraulic diverter 12 with double shaped disc, and a particular channel inside the metal plate 1.1.

Said mechanical articulation 11 is formed of an upper joint 11.1 angularly constrained to the handgrip 2 by means of two flats 11.5 and which, by means of a T-end shaft 11.2, determines the angular rotation of the lower joint 11.3 and therefore, in turn, controls the position of the hydraulic diverter 12.

The upper shaped disc 12.1 of the diverter 12 has in the centre a shaped hole 12.2 and at the sides two notches 12.3 which allow synchronized assembly, and are useful for rotation via the lower joint 11.3 provided with appropriate teeth 11.4 which slot into the respective notches 12.3. The lower disc 12.4 of the diverter 12 is provided with a central hole 12.5, a front hole 12.6 and a rear hole 12.7, and furthermore with two notches 12.8 useful for synchronized assembly with respect to a cover 1.7 of the plate 1.1.

The shaped hole 12.2 present on the upper disc 12.1 has been purposely designed so as to allow simultaneous opening of the front hole 12.6 and rear hole 12.7 of the lower disc 12.4 during rotation of the handgrip 2: in this way the heating system will never be in overpressure since the steam will always have, at least, a way out.

The plate 1.1 has, in particular, a sort of labyrinth circuit 1.6 inside which the water that enters the two central chambers 1.9 through the two holes 1.8 of the cover 1.7 is vaporized.

In use, the steam generated, passing over the electrical resistance 1.2 of the two lateral channels 1.10 and reaching the outlet hole 1.11 on the cover 1.7, enters the hydraulic diverter 12 through the central hole 12.5 of the lower disc 12.4: according to the position of the handgrip 2 with respect to the plate body 1 and consequently the position of the upper disc 12.1, through the shaped hole 12.2, the steam is diverted to flow out from the front hole 12.6 or from the rear hole 12.7.

If the steam is diverted into the rear hole 12.7 it means that the handgrip 2 is in the garment steamer mode (FIG. 2), therefore through the central duct 1.12 of the plate 1.1 the steam reaches the rear chamber 1.13 and then flows out from the upper holes 9 of the metal plate 1.1.

If, on the other hand, the steam is diverted into the front hole 12.6 it means that the handgrip 2 is in the iron mode (FIG. 3): the steam directly reaches the front chamber 1.14 and then flows out from the front holes 10 of the plate 1.1.

Figure 8A:
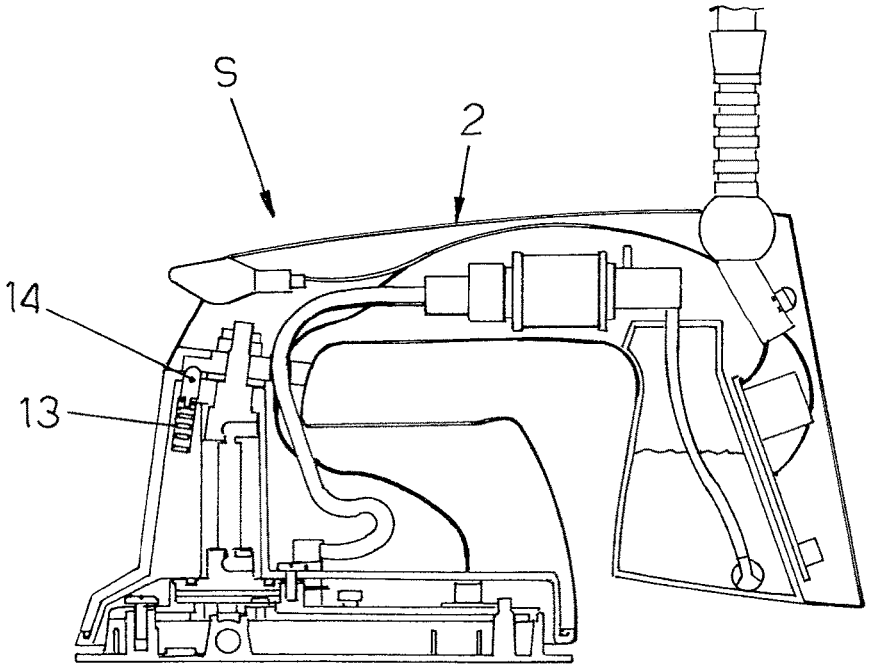
FIGS. 8A to 8C show respectively a lateral view in section of the ironing appliance in question, a perspective view and a frontal view of a portion of the appliance.
Figure 8B:
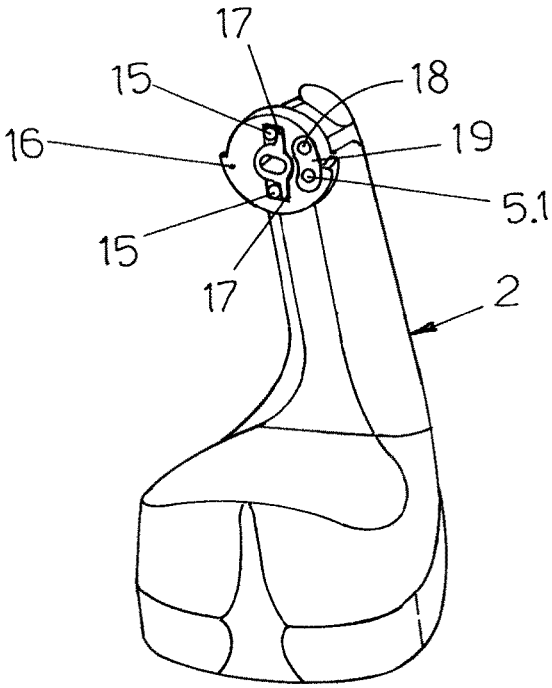
Figure 8C:
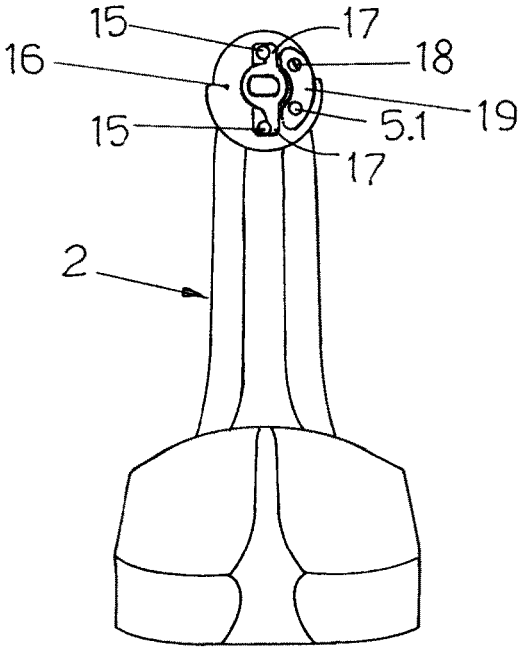

As illustrated better in FIGS. 8A to 8C, a stroke end assembly of the angular rotation of 180° of the handgrip 2 is formed of a spring 13 which pushes a sphere or a spherical pin 14 adapted to snap into one of the two semi-spherical seats 15 obtained on the lower circular surface 16 of the handgrip 2. Therefore, said system offers the user the advantage of perceiving the classic stroke end click.

Furthermore, two stop tabs 17 obtained on the lower circular surface 16 of the handgrip 2 prevent the handgrip from rotating by more than 180° which would cause excessive torsional stress on the water tube 5.1 and on the relative electrical wires 18 which pass into and are guided though a slot 19.

The invention claimed is:

1. An appliance for ironing clothes and similar, comprising a body adapted to support a soleplate and fixed to a handgrip; heating means arranged within said body and connectable to an electricity network for the heating of said plate; and means for generating steam connected to a water tank and to said plate to diffuse steam towards the outside via first and second holes arranged on said plate; said body being mounted rotatable around an axis of lateral rotation passing through said handgrip; said axis passing through said handgrip at the front portion of the handgrip and being inclined by an angle with respect to said handgrip so as to allow a user of the appliance to move said body and said plate between a first operating position for ironing said clothes in direct contact with said plate, and a second operating position for vertical steam ironing of said clothes also not directly in contact with the clothes; characterized in that at said second operating position for vertical ironing said plate is arranged in a position rotated by 180° around said axis with respect to the position assumed by said plate in said first operating position;

articulation means arranged inside said handgrip to allow said rotation of said handgrip with respect to said body;

said articulation means comprise a mechanical articulation adapted to control a hydraulic diverter with double shaped disc, and a channel inside said plate; said mechanical articulation being formed of an upper joint angularly constrained to said handgrip and adapted, by means of a T-end shaft, to determine the angular rotation of a lower joint to control the position of said hydraulic diverter.

2. The appliance according to claim 1, characterized in that said angle (β) assumes a value=0 so that said handgrip is always parallel to the plate also during the lateral rotation of said parts.

3. The appliance according to claim 1, characterized in that said angle (β) assumes a value>0 so that said handgrip is always overlapping the plate with different relative inclinations.

4. An appliance for ironing clothes and similar, comprising a body adapted to support a soleplate and fixed to a handgrip; heating means arranged within said body and connectable to an electricity network for the heating of said plate; and means for generating steam connected to a water tank and to said plate to diffuse steam towards the outside via first and second holes arranged on said plate; said body being mounted rotatable around an axis of lateral rotation passing through said handgrip; said axis passing through said handgrip at the front portion of the handgrip and being inclined by an angle with respect to said handgrip so as to allow a user of the appliance to move said body and said plate between a first operating position for ironing said clothes in direct contact with said plate, and a second operating position for vertical steam ironing of said clothes also not directly in contact with the clothes; characterized in that at said second operating position for vertical ironing said plate is arranged in a position rotated by 180° around said axis with respect to the position assumed by said plate in said first operating position further characterized in that at said first operating position said steam is adapted to flow out through said first holes, and at said second operating position said steam is adapted to flow out through said second holes.

5. An appliance for ironing clothes and similar, comprising a body adapted to support a soleplate and fixed to a handgrip; heating means arranged within said body and connectable to an electricity network for the heating of said plate; and means for generating steam connected to a water tank and to said plate to diffuse steam towards the outside via first and second holes arranged on said plate; said body being mounted rotatable around an axis of lateral rotation passing through said handgrip; said axis passing through said handgrip at the front portion of the handgrip and being inclined by an angle with respect to said handgrip so as to allow a user of the appliance to move said body and said plate between a first operating position for ironing said clothes in direct contact with said plate, and a second operating position for vertical steam ironing of said clothes also not directly in contact with the clothes; characterized in that at said second operating position for vertical ironing said plate is arranged in a position rotated by 180° around said axis with respect to the position assumed by said plate in said first operating position further characterized in that said first holes and said second holes are arranged on the opposite side of the surface of said plate.

6. An appliance for ironing clothes and similar, comprising a body adapted to support a soleplate and fixed to a handgrip; heating means arranged within said body and connectable to an electricity network for the heating of said plate; and means for generating steam connected to a water tank and to said plate to diffuse steam towards the outside via first and second holes arranged on said plate; said body being mounted rotatable around an axis of lateral rotation passing through said handgrip; said axis passing through said handgrip at the front portion of the handgrip and being inclined by an angle with respect to said handgrip so as to allow a user of the appliance to move said body and said plate between a first operating position for ironing said clothes in direct contact with said plate, and a second operating position for vertical steam ironing of said clothes also not directly in contact with the clothes; characterized in that at said second operating position for vertical ironing said plate is arranged in a position rotated by 180° around said axis with respect to the position assumed by said plate in said first operating position further characterized in that it further comprises blocking means for blocking the rotation of said handgrip beyond a given angle of rotation.

* * * * *